US006220253B1

(12) United States Patent
Wright

(10) Patent No.: US 6,220,253 B1
(45) Date of Patent: Apr. 24, 2001

(54) DENTAL IMPLEMENT STORAGE ASSEMBLY

(76) Inventor: Ann Marie Wright, 11216 S. Harvard Blvd., Los Angeles, CA (US) 90047

( * ) Notice: Subject to any disclaimer, the term of this patent is extended or adjusted under 35 U.S.C. 154(b) by 0 days.

(21) Appl. No.: 09/484,385

(22) Filed: Jan. 14, 2000

(51) Int. Cl.[7] ..... A45D 44/18

(52) U.S. Cl. ..... 132/310; 132/315; 132/314; 206/228; 206/581

(58) Field of Search ..... 132/310, 315, 132/309, 308, 312, 290, 295, 314; 206/223, 38, 362.1, 15.2, 581; 220/4.22; D6/528, 534

(56) References Cited

U.S. PATENT DOCUMENTS 1,683,851 * 9/1928 Wells ..... 132/310
1,780,757 * 11/1930 Lawson, Sr. et al. ..... 132/310
5,215,193 * 6/1993 Dennis ..... 206/223
5,908,108 * 6/1999 Svopa ..... 206/223

* cited by examiner

*Primary Examiner*—Pedro Philogene

(57) ABSTRACT

A dental implement storage assembly for holding primary dental care implements and providing storage compartments, a mirror, and a cover usable as a rinsing cup. The dental implement storage assembly includes a housing having a plurality of receptacles for holding dental implements, a plurality of compartments having doors positioned around the outside of the housing, and a cover removable from the housing for use as a cup. A mirror is positioned in one of the compartments.

15 Claims, 2 Drawing Sheets

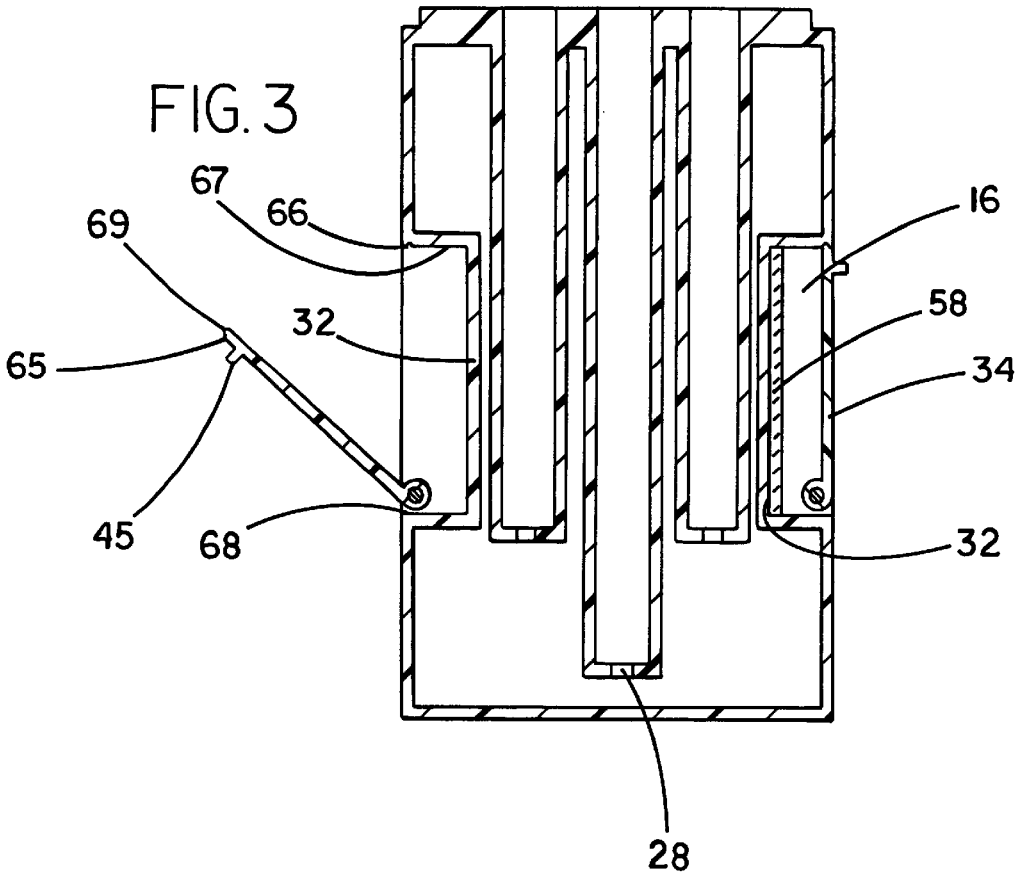
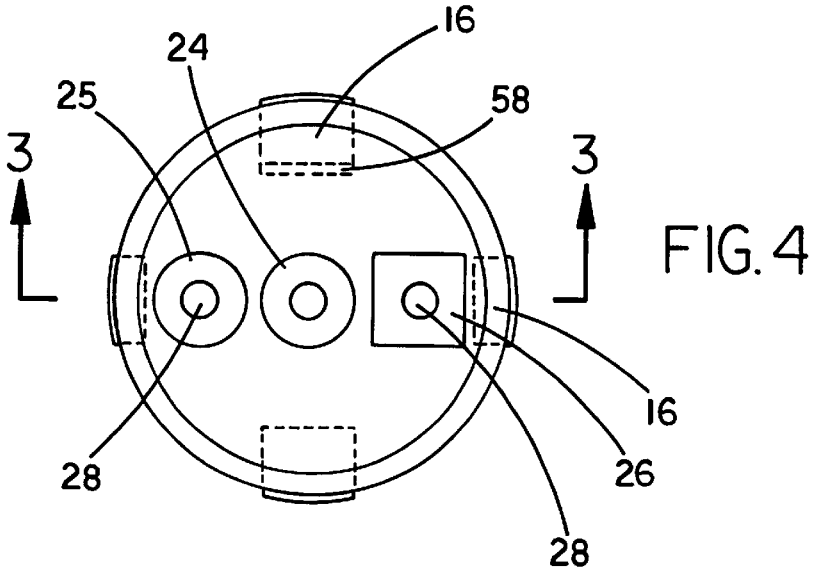
FIG. 4

DENTAL IMPLEMENT STORAGE ASSEMBLY

BACKGROUND OF THE INVENTION

1. Field of the Invention

The present invention relates to dental implement holders and more particularly pertains to a new dental implement storage assembly for holding primary dental care implements and providing storage compartments, a mirror, and a cover usable as a rinsing cup.

2. Description of the Prior Art

The use of dental implement holders is known in the prior art. More specifically, dental implement holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,099,273; U.S. Pat. No. Des. 324,792; U.S. Pat. No. 4,768,530; U.S. Pat. No. 5,095,924; U.S. Pat. No. 1,838,687; and U.S. Pat. No. 5,738,122.

While these devices fulfill their respective, particular objectives and requirements, the aforementioned patents do not disclose a new dental implement storage assembly. The inventive device includes a housing having a plurality of receptacles for holding dental implements, a plurality of compartments having doors positioned around the outside of the housing, and a cover removable from the housing for use as a cup. A mirror is positioned in one of the compartments.

In these respects, the dental implement storage assembly according to the present invention substantially departs from the conventional concepts and designs of the prior art, and in so doing provides an apparatus primarily developed for the purpose of holding primary dental care implements and providing storage compartments, a mirror, and a cover usable as a rinsing cup.

SUMMARY OF THE INVENTION

In view of the foregoing disadvantages inherent in the known types of dental implement holders now present in the prior art, the present invention provides a new dental implement storage assembly construction wherein the same can be utilized for holding primary dental care implements and providing storage compartments, a mirror, and a cover usable as a rinsing cup.

The general purpose of the present invention, which will be described subsequently in greater detail, is to provide a new dental implement storage assembly apparatus and method which has many of the advantages of the dental implement holders mentioned heretofore and many novel features that result in a new dental implement storage assembly which is not anticipated, rendered obvious, suggested, or even implied by any of the prior art dental implement holders, either alone or in any combination thereof.

To attain this, the present invention generally comprises a housing having a plurality of receptacles for holding dental implements, a plurality of compartments having doors positioned around the outside of the housing, and a cover removable from the housing for use as a cup. A mirror is positioned in one of the compartments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dental implement storage assembly apparatus and method which has many of the advantages of the dental implement holders mentioned heretofore and many novel features that result in a new dental implement storage assembly which is not anticipated, rendered obvious, suggested, or even implied by any of the prior art dental implement holders, either alone or in any combination thereof.

It is another object of the present invention to provide a new dental implement storage assembly that may be easily and efficiently manufactured and marketed.

It is a further object of the present invention to provide a new dental implement storage assembly that is of a durable and reliable construction.

An even further object of the present invention is to provide a new dental implement storage assembly which is susceptible of a low cost of manufacture with regard to both materials and labor, and which accordingly is then susceptible of low prices of sale to the consuming public, thereby making such dental implement storage assembly economically available to the buying public.

Still yet another object of the present invention is to provide a new dental implement storage assembly which provides in the apparatuses and methods of the prior art some of the advantages thereof, while simultaneously overcoming some of the disadvantages normally associated therewith.

Still another object of the present invention is to provide a new dental implement storage assembly for holding primary dental care implements and providing storage compartments, a mirror, and a cover usable as a rinsing cup.

Yet another object of the present invention is to provide a new dental implement storage assembly which includes a housing having a plurality of receptacles for holding dental implements, a plurality of compartments having doors positioned around the outside of the housing, and a cover removable from the housing for use as a cup. A mirror is positioned in one of the compartments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention taken along line 3—3 of FIG. 4.

FIG. 4 is a top view of the present invention.

DESCRIPTION OF THE PREFERRED EMBODIMENT

Figure 1:
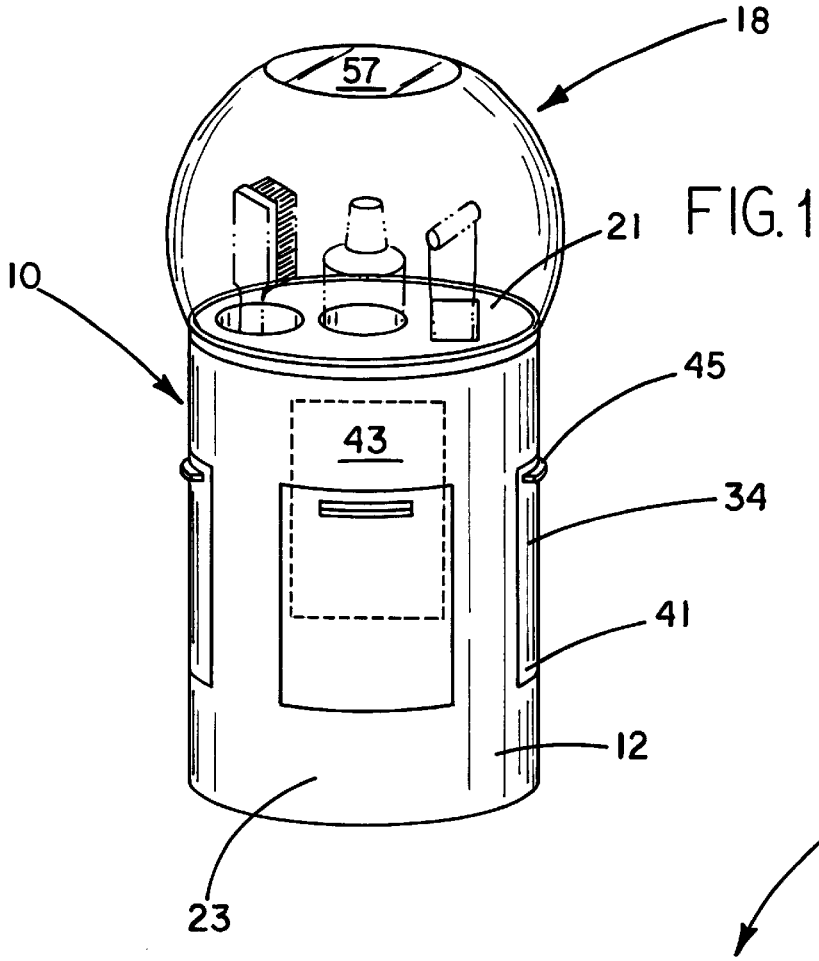
FIG. 1 is a perspective view of a new dental implement storage assembly according to the present invention.
Figure 2:
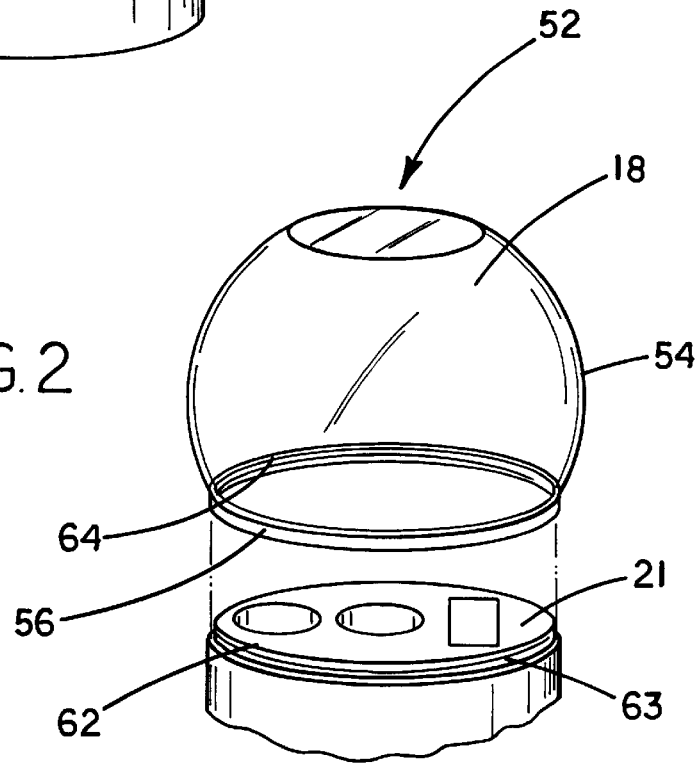
FIG. 2 is a perspective view of the present invention.

With reference now to the drawings, and in particular to FIGS. 1 through 4 thereof, a new dental implement storage assembly embodying the principles and concepts of the present invention and generally designated by the reference numeral 10 will be described.

As best illustrated in FIGS. 1 through 4, the dental implement storage assembly 10 generally comprises a housing 12 having a plurality of receptacles 14, a plurality of compartments 16, and a cover 18.

The housing is generally cylindrical and includes a top 21, a bottom 22, a side wall 23 extending between the top and the bottom, and four compartments 16 positioned in spaced relationship to each other around the housing. The housing is designed to include the receptacles, each of which is designed for holding a dental implement therein. The receptacles are positioned in alignment with each other to include a medial receptacle 24, a first outer receptacle 25, and a second outer receptacle 26.

The medial receptacle extends orthogonally downward from the top of the housing and has a generally circular cross-section. The length of the medial receptacle is greater than that of either of the outer receptacles. The medial receptacle is designed for holding a tube of toothpaste.

The first outer receptacle extends orthogonally downward from the top of the housing and has a generally circular cross-section. The first outer receptacle is designed for holding a toothbrush.

The second outer receptacle extends orthogonally downward from the top of the housing and has a generally rectangular cross-section. The length of the second outer receptacle is equal to the length of the first outer receptacle. The second outer receptacle is designed for holding a container of mouthwash or the like.

Each of the receptacles 24, 25, and 26 includes a respective drain hole 28 for preventing accumulation of fluid in the receptacles.

As previously stated, the housing is configured to include a plurality of compartments 16 in the side wall. Each of the compartments is generally rectangular and includes an inner rear wall 32 positioned opposite an opening 33 in the side wall of the housing. A plurality of doors 34 are provided. Each of the doors is coupled to the housing for covering an associated one of the compartments.

Each of the doors is coupled to the housing such that an outer surface 41 of each of the doors is positioned flush with an outer surface 43 of the side wall. Each of the doors includes an associated handle 45 extending outwardly from the outer surface of the door for facilitating opening of the door.

The cover includes a substantially planar portion 52 and a perimeter wall 54 extending from the planar portion to form an opening 56 opposite the planar portion. The opening is couplable to the housing for covering the receptacles in the housing. The planar portion has an outer surface 57 designed for being supported by a surface thereby facilitating use of the cover as a cup when the cover is positioned in an inverted orientation.

In an embodiment, a mirror 58 is coupled to the rear inner wall of one of the compartments.

The housing further includes a connection portion 62 around the top of the housing. The connection portion is recessed from the outer surface of the side wall of the housing such that an outer surface 63 of the opening of the cover is positioned flush with the outer surface of the side wall when the cover is coupled to the housing. The connection portion of the housing is threaded and an inner surface 64 of the opening of the cover includes threading complimentary to the threaded connection portion such that the cover is threadably engageable to the housing.

The perimeter wall of the cover is arcuate such that an outer surface of the perimeter wall is convex.

Each compartment includes a groove 66 positioned proximate a respective upper edge 67 of each compartment. A lower edge 68 of each door is hingably coupled to the associated compartment. Each door includes a lip 69 positioned along a respective upper edge 65 of each door for engaging the groove of the associated compartment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dental implement storage assembly, comprising:

a housing having a top, a bottom, and a side wall extending between said top and said bottom;

said housing being configured to include a plurality of receptacles, each receptacle being adapted for holding a dental implement therein;

said housing further being configured to include a plurality of compartments in said side wall;

a plurality of doors, each of said doors being coupled to said housing for covering an associated one of said compartments;

a cover having an substantially planar portion and a perimeter wall extending from said planar portion to form an opening opposite said planar portion, said opening being couplable to said housing for covering said receptacles in said housing; and wherein said planar portion has an outer surface adapted for being supported by a surface thereby facilitating use of said cover as a cup when said cover is positioned in an inverted orientation.

2. The dental implement storage assembly of claim 1, further comprising:

said housing being generally cylindrical and having four compartments, said compartments being positioned in spaced relationship to each other around said housing.

3. The dental implement storage assembly of claim 1, further comprising:

a mirror coupled to a rear interior wall of one of said compartments.

4. The dental implement storage assembly of claim 1, further comprising:

each of said doors being coupled to said housing such that an outer surface of each of said doors is positioned flush with an outer surface of said side wall; and each of said doors having an associated handle extending outwardly from said outer surface of said door for facilitating opening of said door.

5. The dental implement storage assembly of claim 1, further comprising:

said plurality of receptacles being positioned in alignment and including a medial receptacle, a first outer receptacle, and a second outer receptacle.

6. The dental implement storage assembly of claim 5, further comprising:

said medial receptacle extending orthogonally downward from said top of said housing, said medial receptacle having a generally circular cross-section.

7. The dental implement storage assembly of claim 5, further comprising:

said first outer receptacle extending orthogonally downward from said top of said housing, said first outer receptacle having a generally circular cross-section.

8. The dental implement storage assembly of claim 5, further comprising:

said second outer receptacle extending orthogonally downward from said top of said housing, said first outer receptacle having a generally rectangular cross-section.

9. The dental implement storage assembly of claim 5 wherein a length of said first outer receptacle is equal to a length of said second outer receptacle; and a length of said medial receptacle is greater than a length of said outer receptacles.

10. The dental implement storage assembly of claim 1, further comprising:

said housing including a connection portion around said top of said housing, said connection portion being recessed from an outer surface of said side wall of said housing such that an outer surface of said opening of said cover is positioned flush with said outer surface of said side wall when said cover is coupled to said housing.

11. The dental implement storage assembly of claim 10, further comprising:

said connection portion of said housing being threaded; and an inner surface of said opening of said cover having threading complimentary to said threaded connection portion such that said cover is threadably engageable to said housing.

12. The dental implement storage assembly of claim 1, further comprising:

said perimeter wall of said cover being arcuate such that an outer surface of said perimeter wall is convex.

13. The dental implement storage assembly of claim 1, further comprising:

each compartment having a groove positioned proximate a respective upper edge of each compartment;

a lower edge of each door being hingably coupled to said associated compartment; and each door including a lip positioned along a respective upper edge of each door for engaging said groove of said associated compartment.

14. The dental implement storage assembly of claim 1, further comprising:

each of said plurality of receptacles having an associated drain hole for preventing retention of a liquid in said plurality of receptacles.

15. A dental implement storage assembly, comprising:

a housing having a top, a bottom, and a side wall extending between said top and said bottom;

said housing being configured to include a plurality of receptacles, each receptacle being adapted for holding a dental implement therein;

said housing further being configured to include a plurality of compartments in said side wall;

a plurality of doors, each of said doors being coupled to said housing for covering an associated one of said compartments;

a cover having an substantially planar portion and a perimeter wall extending from said planar portion to form an opening opposite said planar portion, said opening being couplable to said housing for covering said receptacles in said housing;

wherein said planar portion has an outer surface adapted for being supported by a surface thereby facilitating use of said cover as a cup when said cover is positioned in an inverted orientation;

said housing being generally cylindrical and having four compartments, said compartments being positioned in spaced relationship to each other around said housing;

a mirror coupled to a rear interior wall of one of said compartments;

each of said doors being coupled to said housing such that an outer surface of each of said doors is positioned flush with an outer surface of said side wall;

each of said doors having an associated handle extending outwardly from said outer surface of said door for facilitating opening of said door;

said plurality of receptacles being positioned in alignment and including a medial receptacle, a first outer receptacle, and a second outer receptacle;

said medial receptacle extending orthogonally downward from said top of said housing, said medial receptacle having a generally circular cross-section;

said first outer receptacle extending orthogonally downward from said top of said housing, said first outer receptacle having a generally circular cross-section;

said second outer receptacle extending orthogonally downward from said top of said housing, said first outer receptacle having a generally rectangular cross-section;

wherein a length of said first outer receptacle is equal to a length of said second outer receptacle;

a length of said medial receptacle is greater than a length of said outer receptacles;

said housing including a connection portion around said top of said housing, said connection portion being recessed from said outer surface of said side wall of said housing such that an outer surface of said opening of said cover is positioned flush with said outer surface of said side wall when said cover is coupled to said housing;

said connection portion of said housing being threaded;

an inner surface of said opening of said cover having threading complimentary to said threaded connection portion such that said cover is threadably engageable to said housing;

said perimeter wall of said cover being arcuate such that an outer surface of said perimeter wall is convex;

each compartment having a groove positioned proximate a respective upper edge of each compartment;

a lower edge of each door being hingably coupled to said associated compartment;

each door including a lip positioned along a respective upper edge of each door for engaging said groove of said associated compartment; and each of said plurality of receptacles having an associated drain hole for preventing retention of a liquid in said plurality of receptacles.

* * * * *